United States Patent [19]

Pabsdorff

[11] 4,047,486

[45] Sept. 13, 1977

[54] EXCAVATOR BLADE FOR REPLACING RAILROAD SLEEPERS

[75] Inventor: Melvin Pabsdorff, Hamar, Norway

[73] Assignee: A/S Hymas, Brumunddal, Norway

[21] Appl. No.: 597,948

[22] Filed: July 21, 1975

[51] Int. Cl.[2] ..... E01B 27/02; E01B 29/06

[52] U.S. Cl. ..... 104/9; 37/106; 214/145 R

[58] Field of Search ..... 104/6, 9; 171/16; 37/104–107; 214/145 R, 138 R

[56] References Cited

U.S. PATENT DOCUMENTS

| | | | |
|---|---|---|---|
| 2,754,601 | 7/1956 | Meyer | 37/104 X |
| 2,997,001 | 8/1961 | Scheuchzer | 104/6 X |
| 3,305,952 | 2/1967 | Dressler | 37/104 |
| 3,349,717 | 10/1967 | Blix, Jr. et al. | 104/9 |
| 3,436,849 | 4/1969 | Haynes | 214/138 R |
| 3,691,957 | 9/1972 | Plasser et al. | 104/9 |

*Primary Examiner*—Robert J. Spar
*Assistant Examiner*—Carl Rowold
*Attorney, Agent, or Firm*—Finnegan, Henderson, Farabow & Garrett

[57] ABSTRACT

Railroad sleepers are replaced by removal of old sleepers over a track length corresponding to the length of a sleeper while ballast is removed to a depth corresponding to the height of new sleepers and is placed beside the track whereafter one or more new sleepers are lowered between the rails and rotated into correct transverse position followed by packing the ballast under the sleeper(s), and the space between adjacent new sleepers is packed with ballast.

1 Claim, 4 Drawing Figures

EXCAVATOR BLADE FOR REPLACING RAILROAD SLEEPERS

Figure 1:
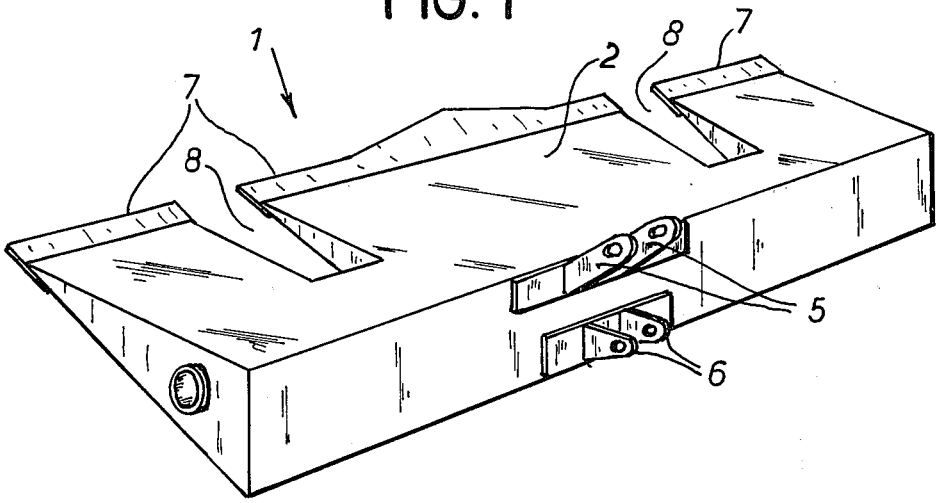

The present invention relates to a method for replacing sleepers for railroad track, and an arrangement in connection with a blade for carrying out said method, which blade is to be mounted on an excavator arm and orientated across the railroad track in use.

The railroad companies have to replace several hundred thousand of sleepers every year. In the 10-year plan of Norges Statsbaner it is calculated that 2.500.000 concrete sleepers will be placed. The method below primarily relates to the replacement of concrete sleepers, but the system will work as effectively for wooden sleepers.

When sleepers have had to be replaced, the sleepers were generally removed and the ballast (broken stone) levelled. This ballast then formed the foundation for the new sleeper. When a new sleeper had been correctly placed new ballast, which is an expensive material, was supplied between the newly laid sleepers. Because of this method the railroad track were raised for each replacement, which in turn had several disadvantageous consequences:

1. The track was unstable and adjustments had to be made to keep the trains going even with reduced speed, and additional ballast had to be supplied.
2. Due to the slope of the side bank, the foundation became narrower on top, so that new broken stone had to be supplied to the banks so as to secure sufficient stability for the railroad track.
3. Bridges had to be raised in accordance with the raised track.
4. The electric contact line had to be adjusted to a new level.
5. In tunnels the track has to lie at a defined level. Due to this fact a section of the foundation in the tunnels and a section before and after had to be manually excavated so as to balance the difference between the defined level and the new level of the track outside the tunnel.

By the new method for replacing sleepers the following operations are carried out by the aid of an excavator having a special blade, after the sleepers have been loosened from the rails.

1. Excavation between old sleepers and removal of same while removing broken stone along the track for the formation of an opening in the foundation below the track, which opening is at least as long as the length of the sleepers.
2. Packing the broken stone beneath the new sleepers when said sleepers have been placed and secured to the rails.
3. Transport of broken stone to fill the space between sleepers.
4. During transport of the excavator along the track, the blade which is provided with a pair of flange wheels can be rotated so that the flange wheels cooperate with the track to guide the excavator.
5. The excavator is provided with specially shaped supporting legs which are placed upon the newly laid broken stone between the sleepers, and cause the broken stone to vibrate at the ends of the sleepers during the further excavation due to the load and shaking to which the excavator is subjected. During the progressing work there will always be free track lengths of about 2,30 m. The free track lengths are secured to the sleepers and the ballast at both ends, and for such short distances as 2,30 m the tracks are sufficiently rigid (49 kg/m) to prevent changes of their position. This means that a properly adjusted track will remain adjusted after the working operations have been completed. Traffic thus can be maintained safely and with greater speed than conventionally during such operations.

For carrying out the method a special blade is used, as mentioned above, which is at least as wide as the sleeper length and has two recesses mutually spaced apart in accordance with the distance between tracks, and with a recess width larger than the track width, and a recess depth at least as big as the sum of the construction height of the track and the sleeper, which form is known per se.

Figure 2:
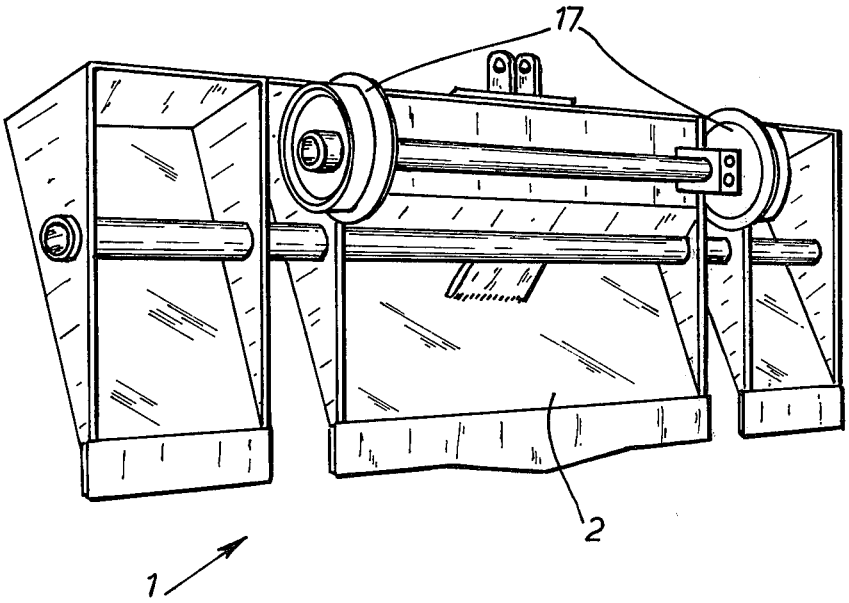
Figure 3:
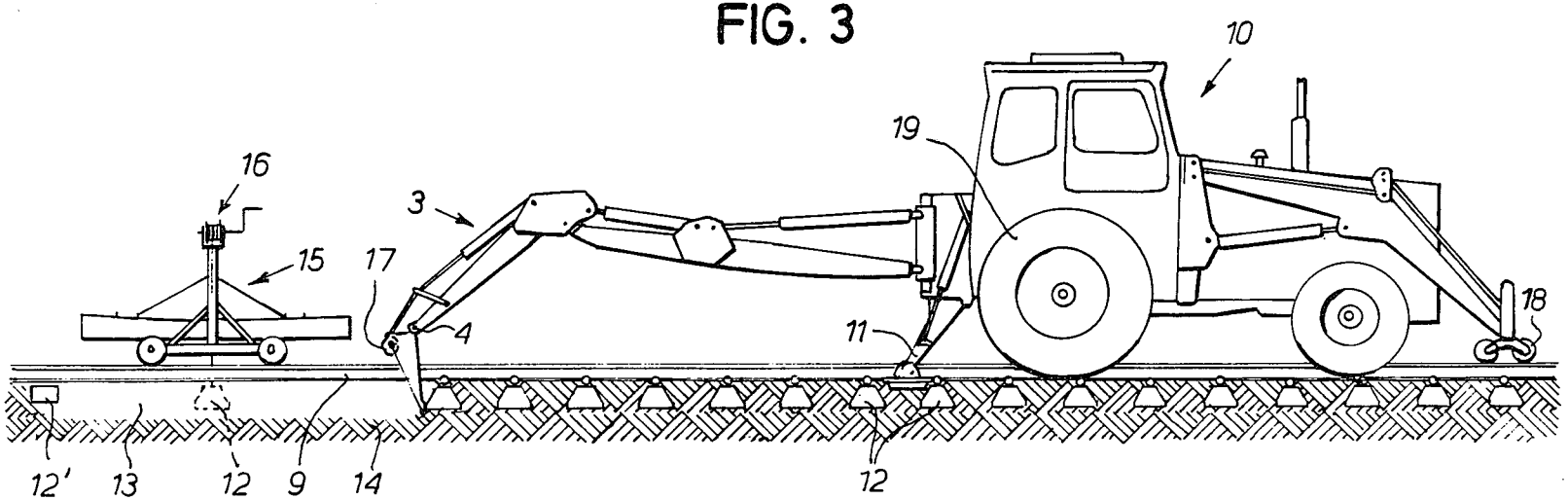

The characterizing features of the invention will appear from the following claims, and the invention is now described in detail with reference to the drawing, where:

FIGS. 1 and 2, respectively, disclose the blade in perspective, seen from above and from below, whereas FIG. 3 shows the excavator with the blade mounted and shown during the replacement of sleepers. FIG. 3 also shows a truck for transport of new sleepers along the track and for lowering sleepers between mounted sleepers in the excavated opening in the foundation and for turning the sleepers around into the correct position across the track.

Figure 4:
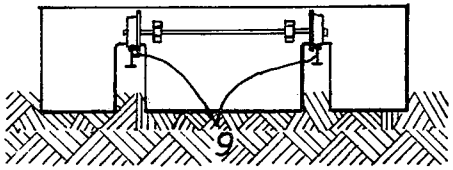

FIG. 4 shows the blade in a working position during excavation or removal of ballast.

The blade 1 consists of a plate 2 as shown in FIGS. 1 and 2, which is mounted into the shovel holder 4 (FIG. 3) of the excavating arm 3 by the aid of securing lugs 5 on the blade. To swing the blade there are lugs 6 spaced apart from the securing lugs 5 for attachment to the hydraulic means of the excavating arm 3. At the front edge of the blade a wearing steel means 7 is arranged and in two places is broken by recesses 8 in blade plate 2. The recesses have a center distance corresponding to the gauge of the track 9, as shown in FIG. 4 and the width of the recesses is larger than the rail width and preferably so large that rails with fish joints can pass through the opening.

As shown in FIG. 3, the excavator, which in the present case is a tractor excavator, has supporting legs 11 to be raised and are of such a shape that they can be lowered between the sleepers. This provides good stability for the excavator and also prevents displacement of the sleepers during the excavation and during the transport of ballast along the track, as well as during the following packing of ballast around the new sleepers. This special construction of the excavator supporting legs also prevents displacement of the sleepers and permits the supporting legs to cause vibration of the newly packed ballast at the same time as the excavation, transport and packing of further ballast takes place. The result is a good and stable track, which railroad trains can pass with higher speed during the operations than has hitherto been possible.

The method for the replacement of concrete sleepers appears from FIG. 3. The tractor excavator 10 by the aid of the blade 1 on the excavating arm 3 is seen digging up old sleepers 12' when these have been loosened from the track 9. An opening 13 in the foundation 14 is excavated in a length at least corresponding to the length of a sleeper and to a depth at least somewhat larger than the height of the new sleeper 12.

The new sleeper 12 which has been placed on the old sleepers 12' between the rails 9 by suitable means not shown, is by the aid of a special truck provided with a winch 16 transported to the opening 13 in the foundation 14 and lowered between and beneath the rails 9, whereafter it is turned across the rails and lifted towards said rails to be mounted in a conventional manner by rail securing means. Then broken stone is packed beneath the new sleeper 12 by the blade 1, which will at first push ballast beneath the new sleeper and pack said ballast, whereupon ballast is filled in between the new sleeper and another, secured sleeper.

Then another sleeper is loosened to maintain enough space between said new sleeper 12 and the old sleepers 12', so that new sleeper 12 can be lowered by the aid of the truck and turned and secured after the opening 13 in the foundation 14 has been enlarged.

These steps are repeated until the desired number of sleepers has been replaced and with use of the ballast already present in the foundation and without any further addition of ballast.

The above described method refers to the replacement of concrete sleepers. These sleepers are so heavy (240 kg) that they cannot be handled without a small truck with a winch as shown in FIG. 3. The same equipment can also be used for the replacement of wooden sleepers. The method is then much simplified, since wooden sleepers have a lower weight so that they can be lifted manually. For replacement an opening in the ballast which leaves space for a new sleeper is then sufficient. The old sleeper is extracted by the blade and the new sleeper is forced into the opening of the old sleeper. When the new sleeper is packed, there will automatically be space enough for the new one.

The blade 1 is at least as wide as the sleepers 12, so as to be able to dig and remove and pack ballast over the entire width of the foundation.

The back of the blade 1 is provided with guiding wheels 17 in line with the recesses 8. The guiding wheels 17 together with guiding wheels 18 on the tractor excavator shovel securing means for a front loader, are used for the transport of the tractor excavator along the track, the guiding wheels 18 on the excavator being urged towards the track at the same time as the guiding wheels 17 on the blade 1 are brought into contact with the track. Thus the tractor excavator is guided on the track, whereas the drive wheels 19 of the tractor excavator, which run about 10 cm outside the track 9, are used for propulsion as they rest on the ballast. The entire weight of the tractor excavator can be transferred to the track by the aid of the guiding wheels 17 and 18, and so the tractor excavator can be safely transported across bridges which are difficult to pass with a conventional tractor excavator.

By the method and the blade as described above, the ballast of the foundation 14 can be excavated and displaced across the entire foundation width with the rails in their correct place, and at the same time the old sleepers can be removed, whereafter the new sleepers can be packed with broken stone ballast from the foundation without any necessity of supplying more broken stone. Thus the level of the rails is not changed and it is not necessary to make adjustments to the contact lines, bridges etc.

I claim:

1. A blade for use with an excavator having a mobile, power-operated, articulated arm and hydraulic means acting in conjunction with the articulated arm, the blade having particular utility in replacing sleepers secured in the foundation ballast of a railroad track, comprising:

a plate including a primary working surface and a reverse surface, said plate having a width at least equal to the width of said replacing sleepers and a depth substantially greater than the distance from the top of the track to the bottom of the foundation, said plate having a pair of recesses symmetrically spaced across the width of one edge thereof, the recesses having a center distance corresponding to the gauge of the track, a width for clearance of the track and a depth at least as large as the sum of the construction height of the rail of the track and the sleeper, said one edge constituting the working edge of the plate;

wearing steel means mounted on said working edge of the plate;

first lug means mounted on said plate proximate the edge opposite said working edge and adjacent said working surface for rotatably securing said blade to said articulated arm;

second lug means aligned with said first lug means and spaced therefrom for securing said blade to the hydraulic means for swinging the blade;

said first and second lug means cooperating respectively with said articulated arm and said hydraulic means at least for actuating the blade for displacing the ballast and replacing the same ballast of said foundation during replacing of said sleepers, and a pair of flanged wheel means mounted on the reverse surface of the plate for supporting one end of said excavator through said articulated arm and for guiding said excavator along said track.

* * * * *